US006089470A

United States Patent [19]

Teerman et al.

[11] Patent Number: 6,089,470

[45] Date of Patent: Jul. 18, 2000

[54] CONTROL VALVE ASSEMBLY FOR PUMPS AND INJECTORS

[75] Inventors: Richard F. Teerman, Wyoming; Thomas Steele, Caledonia; Philip James Czarnecki, Hastings, all of Mich.

[73] Assignee: Diesel Technology Company, Kentwood, Mich.

[21] Appl. No.: 09/265,685

[22] Filed: Mar. 10, 1999

[51] Int. Cl.[7] ..... F02M 47/02; F02M 45/10

[52] U.S. Cl. ..... 239/88; 239/95

[58] Field of Search ..... 239/88, 95

[56] References Cited

U.S. PATENT DOCUMENTS

| | | | |
|---|---|---|---|
| 2,019,650 | 11/1935 | Bischof | 123/139 |
| 2,022,643 | 11/1935 | Hueber et al. | 230/188 |
| 2,190,464 | 2/1940 | Wile | 50/23 |
| 2,770,394 | 11/1956 | Mueller | 222/1 |
| 3,556,464 | 1/1971 | Griswold | 251/64 |
| 3,779,225 | 12/1973 | Watson et al. | 123/139 E |
| 3,810,485 | 5/1974 | Gawlick et al. | 137/71 |
| 3,958,902 | 5/1976 | Toyoda et al. | 417/279 |
| 4,161,161 | 7/1979 | Bastenhof | 123/323 V |
| 4,174,693 | 11/1979 | Steinwart et al. | 123/139 AW |
| 4,214,565 | 7/1980 | Knapp et al. | 123/179 L |
| 4,269,361 | 5/1981 | Seilly | 239/585 |
| 4,303,096 | 12/1981 | Skinner | 137/512 |
| 4,417,693 | 11/1983 | Füssner et al. | 239/453 |
| 4,445,484 | 5/1984 | Marion | 123/502 |
| 4,485,843 | 12/1984 | Wolff | 137/514 |
| 4,501,246 | 2/1985 | LeBlanc | 123/449 |
| 4,569,641 | 2/1986 | Falk et al. | 417/417 |
| 4,618,095 | 10/1986 | Spoolstra | 239/95 |
| 4,619,239 | 10/1986 | Wallenfang et al. | 123/506 |
| 4,627,571 | 12/1986 | Kato et al. | 239/90 |
| 4,628,727 | 12/1986 | Seaman et al. | 73/119 A |
| 4,699,320 | 10/1987 | Sisson et al. | 239/95 |
| 4,730,585 | 3/1988 | Abe et al. | 123/300 |
| 4,747,545 | 5/1988 | Trachte et al. | 239/533.2 |
| 4,782,807 | 11/1988 | Takahashi | 123/506 |
| 4,829,967 | 5/1989 | Nati | 123/506 |
| 4,889,288 | 12/1989 | Gaskell | 239/533.5 |
| 4,911,366 | 3/1990 | Priesner | 239/533.3 |
| 4,917,065 | 4/1990 | Law et al. | 123/458 |
| 4,957,275 | 9/1990 | Homes | 251/129.02 |
| 4,979,674 | 12/1990 | Taira et al. | 239/90 |
| 4,986,728 | 1/1991 | Fuchs | 417/443 |

(List continued on next page.)

FOREIGN PATENT DOCUMENTS

| | | |
|---|---|---|
| 0803 648 A1 | 10/1997 | European Pat. Off. . |
| WO 97/01031 | 1/1997 | WIPO . |

OTHER PUBLICATIONS

U.S. application No. 08/911,819, Straub et al., filed Aug. 15, 1997.

U.S. application No. 09/133,350 Spoolstra, filed Aug. 13, 1998.

U.S. application No. 09/209,725.

*Primary Examiner*—Andres Kashnikow
*Assistant Examiner*—Davis Hwu
*Attorney, Agent, or Firm*—Brooks & Kushman P.C.

[57] ABSTRACT

A control valve assembly for use in a pump or injector of fuel injection systems is provided. A pump or injector body has a pumping chamber, and a valve chamber. The valve chamber defines a valve seat and has an axial guiding portion. A plunger is disposed in the pumping chamber. A valve body disposed in the valve chamber controls fuel. The valve body has a valve stem defining a seating surface. The valve body further has a valve guide in sliding engagement with the valve chamber guiding portion. The valve body is axially movable with respect to the valve chamber over a stroke range. The valve guide has an outer engagement surface that slidingly engages the valve chamber guiding portion with a clearance fit of at least about 5 micrometers in one embodiment. In another embodiment, the axial length of the engagement surface is at most about 7 millimeters. The reduced axial length and/or the clearance fit improve initial sealing performance and sealing performance over the life cycle of the product.

21 Claims, 5 Drawing Sheets

U.S. PATENT DOCUMENTS 5,025,768 6/1991 Eckert ..... 123/506
5,062,449 11/1991 Woollums et al. ..... 137/116.5
5,118,076 6/1992 Homes ..... 251/129.02
5,125,807 6/1992 Kohler et al. ..... 417/490
5,241,935 9/1993 Beck et al. ..... 123/300
5,341,783 8/1994 Beck et al. ..... 123/446
5,345,916 9/1994 Amann et al. ..... 123/506
5,373,828 12/1994 Askaw ..... 123/506
5,385,455 1/1995 Dinsmore et al. ..... 417/505
5,423,484 6/1995 Zuo ..... 239/90
5,425,341 6/1995 Connolly et al. ..... 123/450
5,427,352 6/1995 Brehm ..... 251/64
5,464,334 11/1995 Cook et al. ..... 417/494
5,494,219 2/1996 Maley et al. ..... 239/88
5,517,972 5/1996 Stockner ..... 123/496
5,524,826 6/1996 Mueller et al. ..... 239/88
5,533,481 7/1996 Kronberger ..... 123/299
5,562,428 10/1996 Bailey et al. ..... 417/417
5,566,660 10/1996 Camplin et al. ..... 123/496
5,619,969 4/1997 Liu et al. ..... 123/447
5,632,444 5/1997 Camplin et al. ..... 239/88
5,647,536 7/1997 Yen et al. ..... 239/90
5,651,501 7/1997 Maley et al. ..... 239/88
5,662,087 9/1997 McCandless ..... 123/446
5,669,356 9/1997 Wall et al. ..... 123/467
5,673,853 10/1997 Crofts et al. ..... 239/88
5,685,490 11/1997 Ausman et al. ..... 239/533.9
5,694,903 12/1997 Ganser ..... 123/496
5,706,778 1/1998 Kapus ..... 123/276
5,709,341 1/1998 Graves ..... 239/92
5,711,277 1/1998 Fuseya ..... 123/496
5,727,738 3/1998 Hofmann et al. ..... 239/533.4
5,730,104 3/1998 Hafner ..... 123/446
5,730,261 3/1998 Spakowski et al. ..... 188/299
5,738,075 4/1998 Chen et al. ..... 123/446
5,749,717 5/1998 Straub et al. ..... 417/505
5,752,659 5/1998 Moncelle ..... 239/88
5,765,755 6/1998 Peters et al. ..... 239/124
5,769,319 6/1998 Yen et al. ..... 239/90
5,803,370 9/1998 Heinz et al. ..... 239/533.9
5,860,597 1/1999 Tarr ..... 239/124
5,868,317 2/1999 English ..... 239/88
5,967,413 10/1999 Tian ..... 239/88

CONTROL VALVE ASSEMBLY FOR PUMPS AND INJECTORS

TECHNICAL FIELD

This invention relates to a control valve assembly in a pump or injector of a fuel injection system.

BACKGROUND ART

Fuel control valve assemblies in vehicular fuel injection systems typically include a housing having a control valve chamber, a piston valve body, and a valve stop. Electromagnetic actuators are commonly used in control valve assemblies for electronically controlling actuation of the control valve. The electromagnetic actuator, usually a solenoid, is enclosed in a stator. The valve body is rigidly secured to an armature. A spring is used to urge the valve body toward a deactuated position which places the armature a short distance away from the stator, and which is usually the open position for the control valve. When the solenoid is energized, the armature is pulled toward the stator, against the spring bias, moving the valve body to the actuated position which is usually the closed position for the control valve. In the closed position, a seating surface on the valve body abuts a valve seat defined by the valve chamber. During movement of the valve body between the open and closed positions, a valve guide of the valve body axially slidingly engages a guiding portion of the valve chamber. The electromagnetically actuated valve allows greater sophisticated and more precise control over the injection process, thereby improving combustion.

Although fuel pumps and injectors having electromagnetically actuated control valves have been used in many applications that have been commercially successful, wear and tear may eventually cause degraded valve sealing ability when closed. Further, strict specifications may result in valve sealing performance variations from assembly-to-assembly. As such, both assembly-to-assembly performance variations and wearing of parts can significantly lessen the precision of the fuel flow process, and thereby undesirably lessen the combustion efficiency and decrease the useful life cycle of the control valve assembly.

For the foregoing reasons, there is a need for a control valve assembly for pumps and injectors that overcomes the problems and limitations of the prior art.

DISCLOSURE OF INVENTION

It is, therefore, an object of the present invention to provide improved control valve assemblies having one or more features that reduce assembly-to-assembly performance variations and/or reduce the effects of normal wear and tear on valve sealing ability when closed.

In carrying out the above object and other objects and features of the present invention, a pump for a fuel injection system is provided. The pump comprises a pump body having a pumping chamber. A fuel inlet supplies fuel to the pumping chamber. The pump body further has an outlet port and a valve chamber between the pumping chamber and the outlet port. The valve chamber defines a valve seat and has an axial guiding portion with a central axis. A plunger is disposed in the pumping chamber. A valve body disposed in the valve chamber controls fuel. A valve stem on the valve body defines a seating surface. The valve body further has a valve guide in sliding engagement with the valve chamber guiding portion. The valve body is axially movable with respect to the valve chamber over a stroke range between a closed position and an open position.

In the closed position, the seating surface of the valve body engages the valve seat of the valve chamber. In the open position, the seating surface of the valve body is spaced from the valve seat to allow pressure relief. The valve guide has an outer engagement surface that slidingly engages the valve chamber guiding portion. The engagement surface has an axial length of at most about 7 millimeters. The shortened axial length of the engagement surface (compared to a typical axial length of more than 9 millimeters) improves valve sealing ability initially and over the life cycle of the product.

A valve spring biases the valve body toward the open position. An armature is located at the valve body. A stator near the armature includes an actuator operative to urge the valve body toward the closed position against the bias of the valve spring.

Preferably, the valve seating surface has a radially inner portion and a radially outer portion. The valve seating surface preferably defines a step between the inner and outer portions. The step further improves valve sealing ability over the life cycle of the product.

Further, in carrying out the present invention, a pump for a fuel injection system having an increased clearance fit between the valve chamber guiding portion and the valve body engagement surface is provided. The valve body engagement surface slidingly engages the valve chamber guiding portion with a clearance fit of at least about 5 micrometers (compared to typical clearance fits of less than 4 micrometers). Preferably, the valve seating surface is stepped to improve performance, and preferably the valve body engagement surface has a shortened axial length of at most about 7 millimeters.

The advantages associated with embodiments of the present invention are numerous. For example, pumps and injectors having control valve assemblies made in accordance with the present invention provide pumps and injectors with reduced assembly-to-assembly valve sealing performance variations and/or reduced effects of normal wear and tear on valve sealing ability. That is, it is important that there is minimal fuel leakage and pressure relief between the valve seating surface and the valve seat when the valve is held closed. A critical characteristic of valve sealing ability is the effective surface area of the valve seat that receives closing force from the valve stem while the valve is being held closed. That is, valve sealing ability is related to the closing force per unit of effective surface area on the valve seat that receives the closing force.

In prior art pumps and injectors, although commercially successful, the product wear which may be due to excessive debris in the fuel, causes the control valve seat to degrade, which results in a greater effective area of the valve seat receiving closing force from the valve stem, limiting the ability of the solenoid to hold the valve closed. As such, worn parts may reduce the sealing ability of a prior art control valve assembly. Embodiments of the present invention employ one or more features to reduce the resultant increases in this effective surface area due to wear and tear of the control valve assembly during normal operation, and the increases that may occur due to pump-to-pump or injector-to-injector variability.

The above object and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
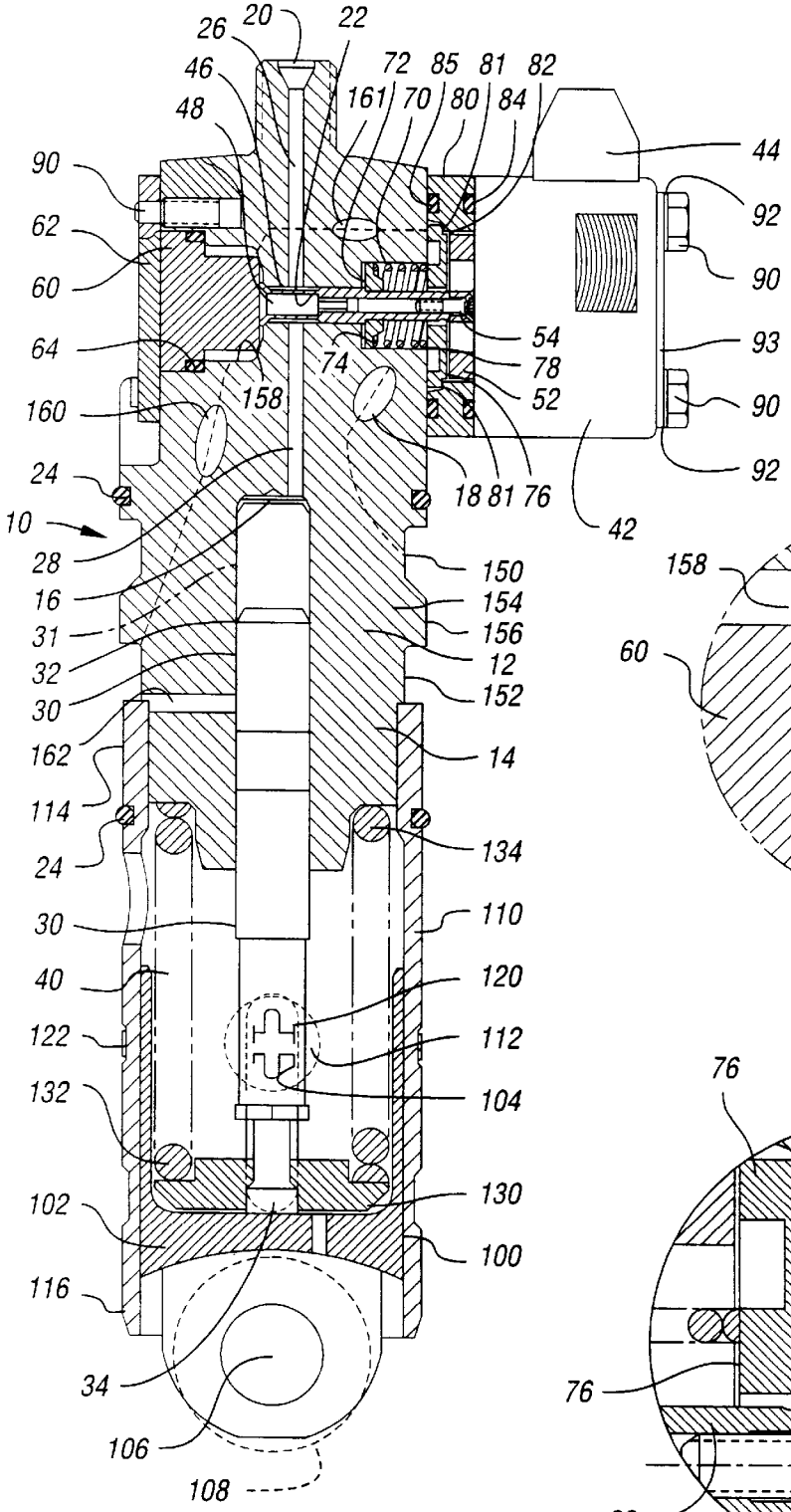
FIG. 1 is a side elevation, in section, of a pump for a fuel injection system made in accordance with the present invention.
Figure 2:
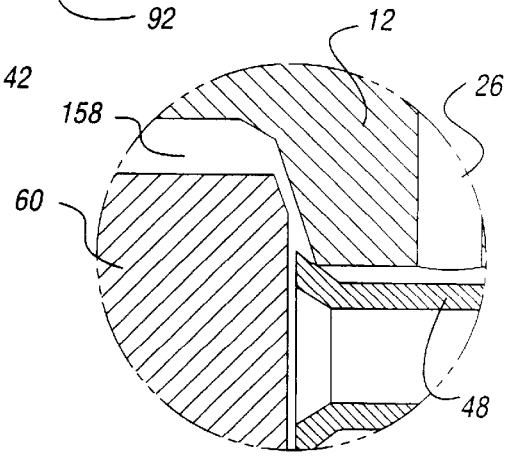
FIG. 2 is an enlarged cross-sectional view of the control valve seat environment on the pump shown in FIG. 1.
Figure 3:
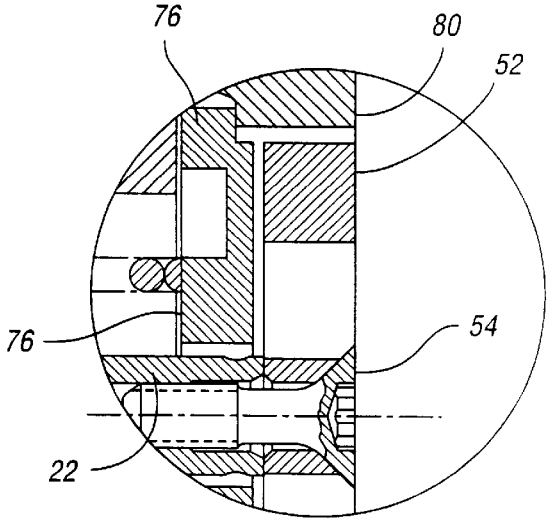
FIG. 3 is an enlarged cross-sectional view of the armature environment on the pump shown in FIG. 1.

Referring to FIGS. 1–3, a pump 10 made in accordance with the present invention is illustrated. The pump 10 has a pump body 12 with a pump body end portion 14. A pumping chamber 16 is defined by pump body 12. A fuel inlet 18 for supplying fuel to pumping chamber 16 is located on the periphery of pump body 12. Pump body 12 further has an outlet port 20, and a control valve chamber 22 between pumping chamber 16 and outlet port 20. O-rings 24 are provided to seal fuel inlet 18 with respect to an engine block which receives pump 10. Passageways 26 and 28 connect outlet port 20, control valve chamber 22, and pumping chamber 16.

A reciprocating plunger 30 is disposed in pumping chamber 16. Plunger 30 has a head end 32 and a tail end 34. Plunger 30 is reciprocatable over a stroke range between an extended position indicated at 30 and a compressed position indicated in phantom at 31. A plunger spring 40 resiliently biases plunger 30 to the extended position 30.

A stator assembly 42 contains an electromagnetic actuator 44, such as a solenoid, and has terminals for connecting to a power source to provide power for electromagnetic actuator 44. An electromagnetically actuated control valve 46 is disposed in control valve chamber 22 for controlling fuel. Control valve 46 includes a piston valve body 48. Piston valve body 48 is movable between a deactuated position and an actuated position within control valve chamber 22.

Typically, the deactuated position is the open position, and the actuated position is the closed position for valve body 48. An armature 52 is secured to control valve 46 by a fastener such as a screw 54. A valve stop 60 is disposed in pump body 12 adjacent to control valve chamber 22.

A control valve spring 70 resiliently biases piston valve body 48 into the deactuated position. A control valve spring seat 72 and a control valve spring retainer 76 abut first and second ends 74 and 78 of control valve spring 70, respectively.

A stator spacer 80 having a central opening 82 for receiving armature 52 therein is disposed between pump body 12 and stator assembly 42. Stator spacer 80 has notches 81 for receiving retainer 76. O-rings 84 and 85 seal stator spacer 80 against stator assembly 42 and pump body 12, respectively.

Stop plate 62 has holes in alignment with holes in pump body 12, and holes and in stator assembly 42 and stator spacer 80, respectively. Fasteners 90 extend through stator assembly 42, stator spacer 80, and pump body 12. Fasteners 90 secure stop plate 62 against valve stop 60. Preferably, washers 92 are used with fasteners 90, and a nameplate 93 may be secured to stator assembly 42 for identification purposes.

With continuing reference to FIGS. 1–3, a cam follower assembly 100 is illustrated. Cam follower assembly 100 has a housing 102 with an elongated slot 104. Cam follower assembly 100 has an axle 106 and a roller 108 for engagement with a camshaft (not shown). Plunger 30 is reciprocated within pumping chamber 16 between the compressed position 31 and the extended position 30 by cam follower assembly 100. A cylindrical sleeve 110 has an aperture 112 in communication with elongated slot 104. Cylindrical sleeve 110 has first and second end portions 114 and 116, respectively. Pump body end portion 14 interfits with first end portion 114 of cylindrical sleeve 110.

Second end portion 116 of cylindrical sleeve 110 relatively reciprocatably interfits with cam follower assembly 100 for allowing cam follower assembly 100 to drive plunger 30. Cam follower assembly 100 reciprocates within cylindrical sleeve 110 and drives plunger 30 relative to cylindrical sleeve 110 over the stroke range. Preferably, a retainer guide 120 extends through aperture 112, cylindrical sleeve 110, and engages slots 104 in cam follower assembly 100. A clip 122 retains guide 120 within aperture 112.

A plunger spring seat 130 is received in housing 102 of cam follower assembly 100. Plunger spring seat 130 abuts a first end 132 of plunger spring 40. Pump body end portion 14 abuts second end 134 of plunger spring 40.

Pump body 12 has a first annulus 150 in communication with fuel inlet 18 for supplying fuel to the pumping chamber 16. Pump body 12 further has a second annulus 152 in communication with pumping chamber 16 for receiving excess fuel therefrom. An annular belt 154 having outer surface 156 separates first and second annuli 150 and 152, respectively.

An excess fuel chamber 158 receives excess fuel from control valve chamber 22. A fuel equalizing passage 161 provides fuel communication between excess fuel chamber 158 and the control valve and spring chambers. 0-ring 64 seals excess fuel chamber 158 with valve stop 60. A return passageway 160 connects excess fuel chamber 158 to second annulus 152. Another return passageway 162 connects pumping chamber 16 to second annulus 152 for receiving any fuel that leaks between plunger 30 and pump body 12. Second annulus 152 is defined by annular belt 154 and first end portion 114 of cylindrical sleeve 110. As well known in the art, fuel is supplied to pump 10 through internal fuel passageways in the engine block (not shown).

With reference now to FIG. 2, piston valve body 48 is shown in the actuated position. Upon actuation, piston valve body 48 is urged inwardly from the open position against valve stop 60 (not specifically shown) to the closed position depicted in FIG. 2. Fuel is allowed to flow through passageway 26 in pump body 12 toward outlet port 20 in accordance with control valve 46 being opened and closed in a fixed sequence allowing the desired fuel pressure to be developed while closed. Passageway 26 is always open to the pumping chamber but fuel flow to the nozzle is precluded, as described, and optionally with the assist of a pressure relief valve (not shown) within the high pressure line, pursuant to conventional practice.

Operation of pump 10 will now be described with reference to FIG. 1. Fuel is received from a fuel supply by first annulus 150 and supplied to fuel inlet 18. Fuel inlet 18 routes fuel to pumping chamber 16. The camshaft (not shown) drives cam follower assembly 100. Plunger 30 is moved from the extended position 30 to the compressed position 31, and fuel is pressurized within pumping chamber 16 when control valve 46 is held closed.

In accordance with the present invention, the valve body guide portion has an outer engagement surface with a shortened axial length of not more than about 7 millimeters and/or the valve body guide portion has an outer engagement surface with a clearance fit of at least about 5 micrometers. Preferably, both the shortened guide portion and the clearance fit are employed in embodiments of the present invention. Further, preferably, a stepped seating surface is employed as well.

Figure 4:
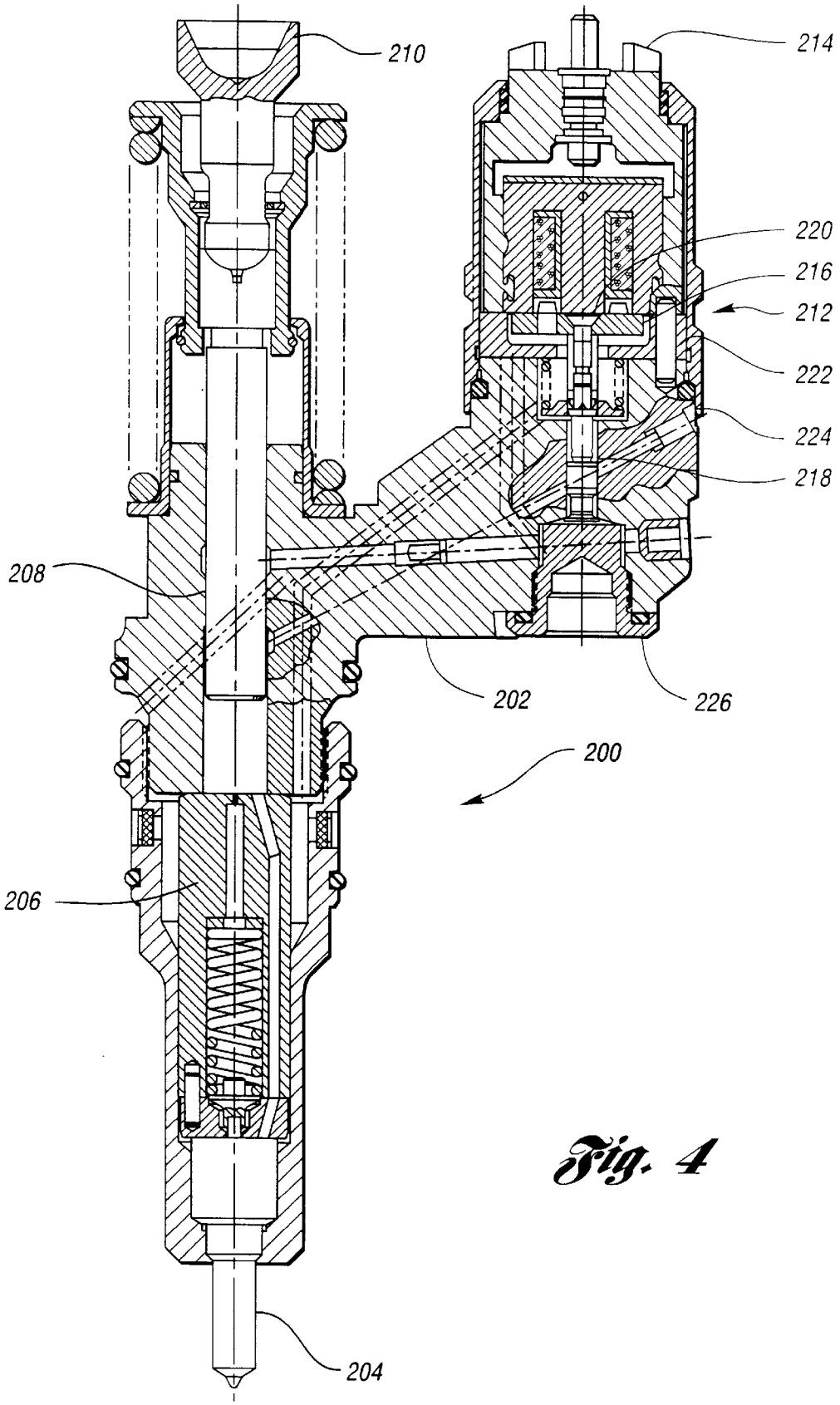
FIG. 4 is a side elevation, in section, of an injector for a fuel injection system made in accordance with the present invention.

Referring to FIG. 4, an injector 200 made in accordance with the present invention is illustrated. Injector 200 has an injector body 202 and a nozzle assembly 204. Spring cage assembly 206 is located adjacent nozzle assembly 204. A plunger 208 is reciprocatably driven within body 202 by a push rod 210. A stator 214 includes an actuator for controlling an electronically controlled valve assembly 212. An armature 216 is secured to a valve body 218 by an armature screw 220. Armature 216 is encircled by a stator spacer 222. Valve body 218 is biased toward a deactuated position by control valve spring 224. Upon actuation, armature 216 is pulled toward stator 214 resulting in valve body 218 moving against the bias of spring 224 into the actuated position. Upon deactuation, valve body 218 is urged by spring 224 to abut valve stop 226. As stated previously for pump 10 (FIG. 1), injector 200 is configured such that the valve body guide portion has an outer engagement surface with a shortened axial length of not more than about 7 millimeters and/or the valve body guide portion has an outer engagement surface with a clearance fit of at least about 5 micrometers. Preferably, both the shortened guide portion and the clearance fit are employed in embodiments of the present invention. Further, preferably, a stepped seating surface is employed as well.

Injector 200 operates in a known manner, as shown, for example, in U.S. Pat. No. 4,618,095, assigned to the assignee of the present invention, and hereby incorporated by reference in its entirety. That is, deactuating the control valve moves the valve body away from its seat to allow pressure relief during pumping. Actuating the control valve closes the relief passage, allowing pressure to build up and eventually lift the nozzle needle in a cascade of hydraulic events.

Figure 5:
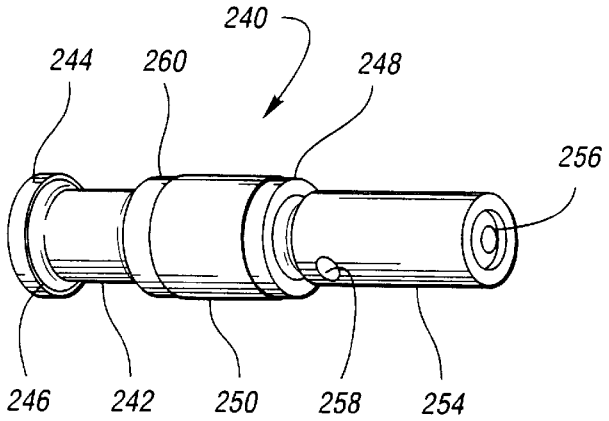
FIG. 5 is a perspective view of a preferred construction for a valve body in accordance with the present invention, having a shortened valve guide outer engagement surface, an increased clearance fit between the engagement surface and the axial guiding portion of the valve chamber, and a stepped valve seating surface.

With reference to FIG. 5, a preferred embodiment of a valve body for use in control valve assemblies of the present invention for pumps and injectors is generally indicated at 240. Valve body 240 has a valve stem 242 defining a seating surface 246. Valve body 240 further has a valve guide 248 intended for sliding engagement with the control valve chamber guiding portion. Valve guide 248 has an outer engagement surface 250 that engages the valve chamber guiding portion. The engagement surface has an axial length of at most about 7 millimeters. The other end 254 of valve body 240 has a threaded aperture 256 for receiving the armature screw to secure the armature to valve body 240. Orifices 258 are provided to allow additional communication between the excess fuel chamber and the control valve spring chambers. A non-engaging surface portion 200 is located on one or both axial sides of surface 250.

Figure 6:
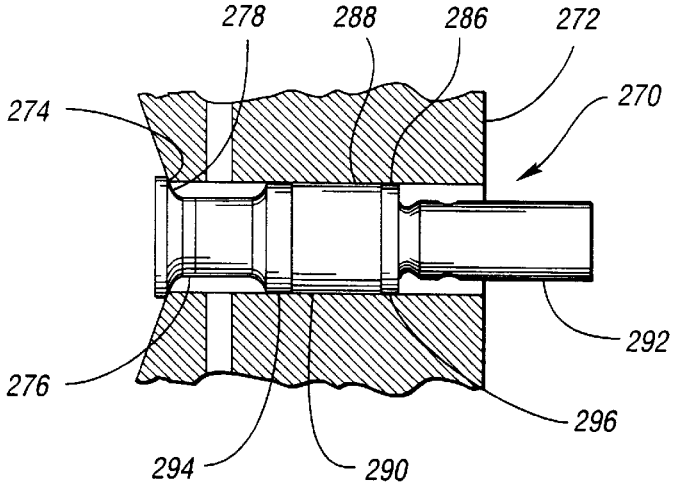
FIG. 6 is a sectional view illustrating a preferred embodiment of a control valve assembly of the present invention.
Figure 7:
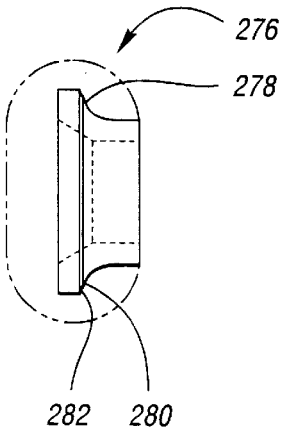
FIG. 7 is an enlarged top view of the seating surface portion of a valve body in a preferred embodiment of the present invention.
Figure 8:
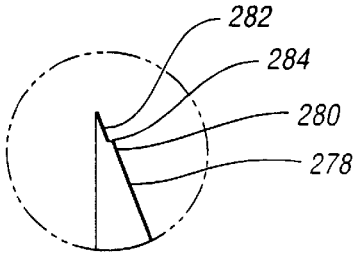
FIG. 8 is a further enlarged view of the seating surface on the valve body shown in FIG. 7.

With reference to FIGS. 6–8, primarily to FIG. 6, a valve body, generally indicated at 270, is shown received within a control valve chamber 272 defined by a pump (or injector) housing. Valve chamber 272 defines a valve seat 274. Valve stem 276 has a seating surface 278 for engaging valve seat 274. As best shown in FIGS. 7 and 8, seating surface 278 has a radially inner portion 280 and a radially outer portion 282. A step 284 (FIG. 8) is defined between the inner and outer portions 280 and 282, respectively.

Valve body 270 has a valve guide 286 with an outer engagement surface 288. Outer engagement surface 288 is preferably at most about 7 millimeters in length and engages axial guiding portion 290. Further, valve body 270 has end 292 for attachment to an armature. Preferably, in addition to having an axial length of at most about 7 millimeters, outer engagement surface 288 engages valve chamber guiding portion 290 with a clearance fit of at least about 5 micrometers.

The reduced guide length and clearance fit improve valve sealing ability initially and over the life cycle of the product. The reduced guide length and increased clearance allows the valve to find its optimum seat (sealing) position.

More particularly, reducing guide length and increasing clearance allows the valve body to ever so slightly rotate and/or translate as needed such that the valve body finds its optimum seat. Of course, over relaxation of the clearance or over reduction of guide length could result in slight pressure relief along a path to the spring chamber.

The inventors have found that a guide length of at most about 7 millimeters is suitable for pump and injector applications. The inventors found it further preferred that the axial length of the engagement surface should be at least about 6 millimeters. In a preferred embodiment, an axial length of at most about 6.7 millimeters is used. Still further, in a preferred embodiment, an axial length of at least about 6.3 millimeters is used. The additional play provided by the shortened guide advantageously facilitates optimum valve seating. For quality reasons, it is preferred that the axial length of the guide be selected such that sealing ability variations for axial lengths within a reasonable tolerance of the selected length are minimized.

The inventors have compared the performance of several valve bodies having different axial lengths and have found that one suitable axial length and tolerance for use in a particular pump application is about 6.5+/−0.2 millimeters. Of course, other axial lengths and tolerances may be found suitable for other applications, as is appreciated by one of ordinary skill in the pump and injector arts.

As best shown in FIG. 6, valve guide 286, in addition to having outer engagement surface 288, has first and second non-engaging surface portions 294 and 296, respectively. Non-engaging surface portion 294, located between surface portion 288 and valve stem 276 preferably has an axial length of at least about 1 millimeter. More preferably, the axial length of non-engaging surface portion 294 is at least about 2 millimeters. The inventors have found that having non-engaging portion 294 larger than non-engaging portion 296 enhances valve sealing performance. That is, shortening the axial guide at the valve stem side will provide more play or freedom at the valve seat than shortening the axial guide at the other end of the valve body. Further, the primary reason for the inclusion of the non-engaging surface portions is to minimize design changes to the valve body but still gain the benefits of the shortened axial guide. Further, although the most play or improvement in valve seating and sealing ability may be achieved by maximizing non-engaging surface area 294 while eliminating non-engaging surface area 296, a short non-engaging surface area 296 may be desirable depending on manufacturing processes used to treat the pump body.

Additionally, the clearance fit between outer engagement surface 288 and guiding portion 290 may be increased to increase play and facilitate optimum seating. It is to be appreciated that embodiments of the present invention may employ the reduced guide length and/or the increased clearance fit. Further, the inventors have found that it is preferred to utilize both the reduced guide length and the clearance fit. A suitable clearance fit that facilitates the valve finding its optimum seat is at least about 5 micrometers. The inventors have found it preferable that the clearance fit is at most about 9 micrometers. Still further, in a preferred embodiment, the clearance fit is at least about 6 micrometers. Even further, in a further preferred embodiment, the clearance fit is at most about 8 micrometers.

The additional play provided by the increased clearance advantageously facilitates optimum valve seating, which is further facilitated by the use of a shortened axial guide in addition to the increased clearance. For quality reasons, it is preferred that the clearance fit be selected such that sealing ability variations for clearance fits within a reasonable tolerance of a selected length are ;minimized. The inventors have found that 7+/−1 micrometer is a suitable clearance and tolerance in a particular pump application. Of course, other clearances and tolerances may be found suitable for other applications.

In a preferred embodiment, a valve body is constructed with the reduced guide length of the axial engagement surface, the clearance fit between the engagement surface and the valve chamber, and the stepped seating. However, it is to be appreciated that embodiments of the present invention may employ the reduced guide length and/or the clearance fit. Further, although the stepped seating is preferred, alternatively, embodiments of the present invention may be implemented without the stepped seating.

Figure 9:
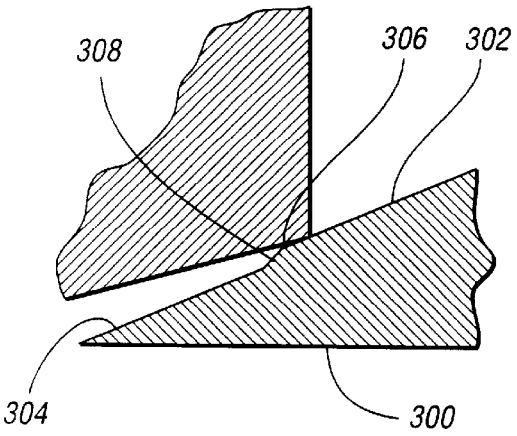
FIG. 9 is an enlarged cross-sectional view showing the preferred seating surface engaging the valve seat.
Figure 10:
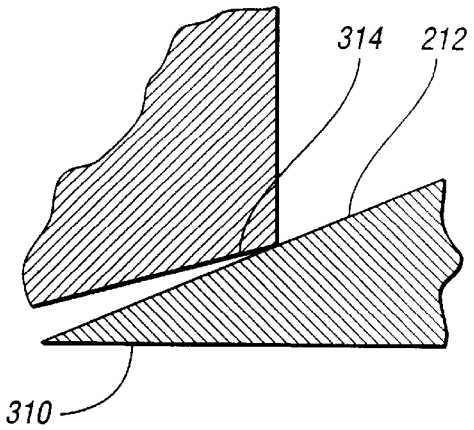
Fig. 10 (PRIOR ART)
FIG. 10 is an enlarged cross-sectional view showing a prior art seating surface engaging the valve seat.

FIGS. 9 through 12 illustrate the advantages of a stepped seating when compared to a non-stepped seating. In FIG. 9, valve stem 300 has inner portion 302 and outer portion 304. In the closed position, inner portion 302 engages valve seat 306. Comparatively, in FIG. 10, conventional valve stem 310 has a seating surface 312 in engagement with valve seat 314.

Figure 11:
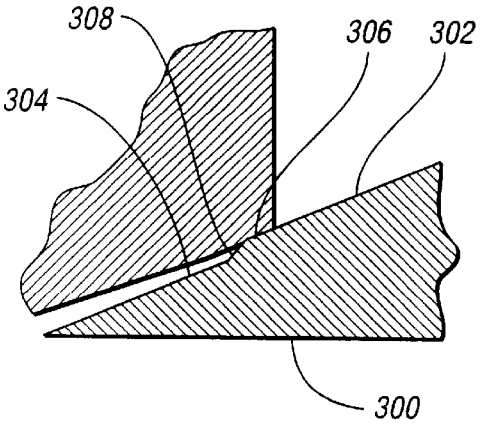
FIG. 11 is an enlarged cross-sectional view showing the preferred seating surface engaging a moderately worn valve seat.

Referring now to FIG. 11, a worn valve seat has a moderately worn seating surface 306. Inner portion 302 of valve stem 300 engages worn valve seat 306. The effective area on valve seat 306 receiving closing force from valve stem 300 has increased slightly in FIG. 11 than the effective area in FIG. 9. The effective force receiving area is the area defined in a plane normal to the valve motion axis. That is, as valve seat 306 becomes worn, the valve body will seat further and further into the valve seat, increasing the effective force receiving area on the valve seat. However, as step 308 on valve body 300, over time, begins to push into valve seat 306, effective force receiving area increases at a slower rate due to the angle of step 308. Of course, the increased angle at step 308 causes valve body 300 to bite into valve step 306 at a faster rate. The inventors have found that the rate of increase of effective force receiving area over time decreases significantly by providing step 308 on valve body 300.

Figure 12:
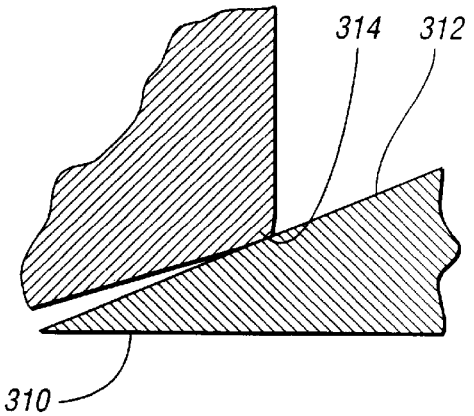
Fig. 12 (PRIOR ART)
FIG. 12 is an enlarged cross-sectional view showing a prior art seating surface engaging a moderately worn valve seat.

As shown in FIG. 12, valve stem 310 pushes into valve seat 314 over time, and increases the effective force receiving area on the valve seat at a faster rate than the valve stem design shown in FIG. 11. The inventors believe that a stepped valve seat enhances valve seating and sealing performance and prefer that a stepped valve seating surface be employed in addition to the shortened axial guide length and the increased clearance at the outer engagement surface of the valve guide.

Of course, the stepped seat is optional, and embodiments of the present invention are achieved with the outer engagement surface of reduced axial length and/or the outer engagement surface having increased clearance, as described above.

Figure 13:
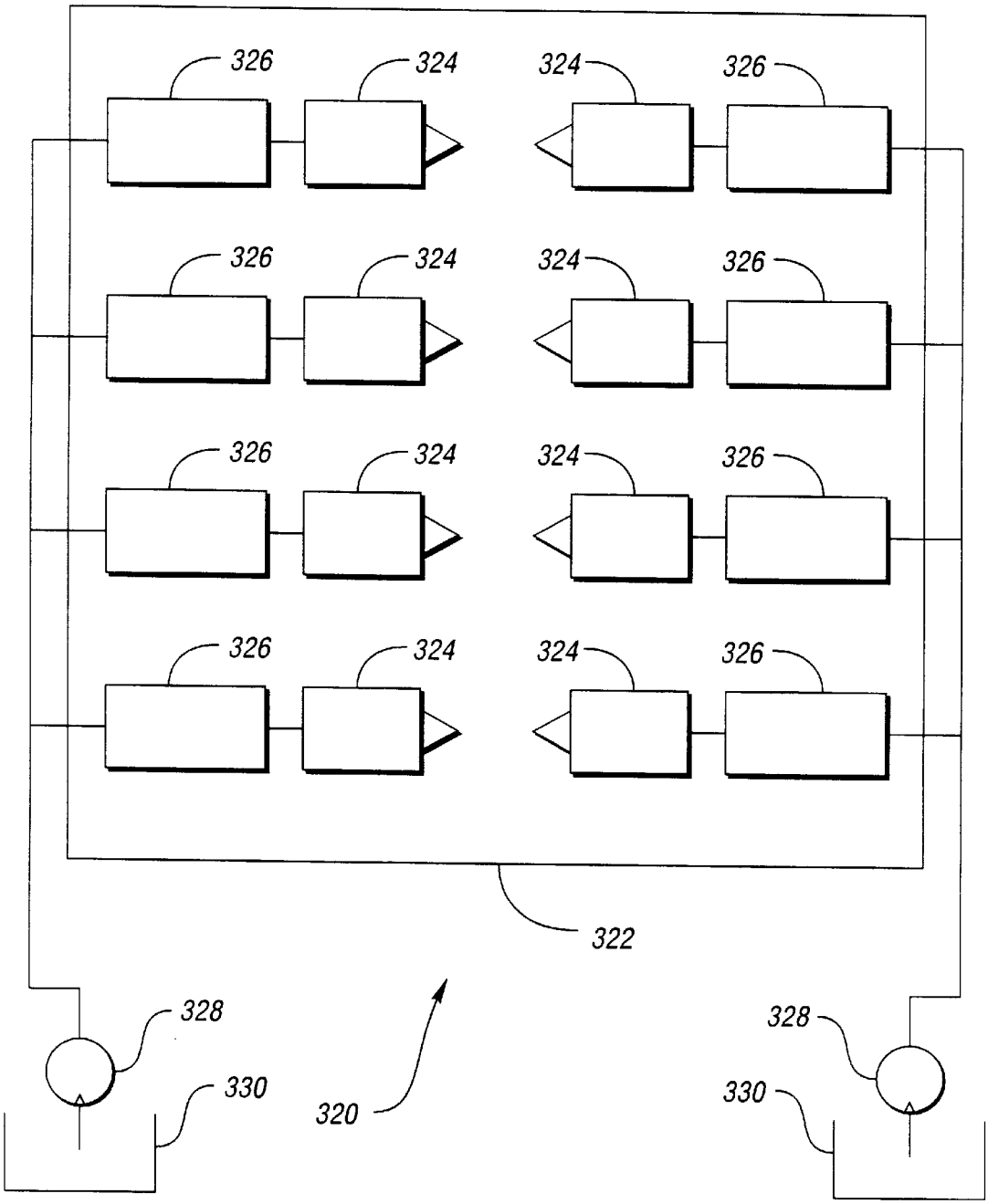
FIG. 13 is an engine made in accordance with the present invention.

Referring to FIG. 13, an engine made in accordance with the present invention is generally indicated at 320. An engine block 322 has a plurality of cylinders. Fuel injectors are positioned to feed fuel to the cylinders. Fuel injectors 324 may be unit injectors having a pumping device and control valve of the present invention incorporated therein, or may be in communication with one or more high pressure pumps. As shown, each injector is in communication with a high pressure pump 326, and an enhanced control valve of the present invention would accordingly be located within each pump 326. Fuel is supplied to engine block 322 by one or more low pressure pumps 328 in communication with one or more fuel supplies 330.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A pump for a fuel injection system, the pump comprising:

a pump body having a pumping chamber, a fuel inlet for supplying fuel to the pumping chamber, an outlet port, and a valve chamber between the pumping chamber and the outlet port, the valve chamber defining a valve seat and having an axial guiding portion with a central axis;

a plunger disposed in the pumping chamber;

a valve body disposed in the valve chamber for controlling fuel, the valve body having a valve stem defining a seating surface, the valve body further having a valve guide in sliding engagement with the valve chamber guiding portion, and the valve body being axially movable with respect to the valve chamber over a stroke range between a closed position in which the seating surface engages the valve seat and an open position in which the seating surface is spaced from the valve seat to allow pressure relief, the valve guide having an outer engagement surface that slidingly engages the valve chamber guiding portion with a clearance fit of a first distance, the engagement surface having an axial length of a second distance, and wherein a ratio of the first distance to the second distance is at least about 5 to 7000;

a valve spring biasing the valve body toward the open position;

an armature at the valve body; and a stator near the armature and including an actuator operative to urge the valve body toward the closed position against the bias of the valve spring.

2. The pump of claim 1 wherein the valve seating surface has a radially inner portion and a radially outer portion, and the valve seating surface defines a step between the inner and outer portions.

3. The pump of claim 1 wherein the ratio is at most about 5 to 6000.

4. The pump of claim 3 wherein the ratio is at least about 5 to 6700.

5. The pump of claim 4 wherein the ratio is at most about 5 to 6300.

6. The pump of claim 1 wherein the valve guide has an axial length of at least about 9 millimeters.

7. The pump of claim 6 wherein the valve guide has a non-engaging surface portion between the outer engagement surface portion and the valve stem, the non-engaging surface portion having an axial length of at least about 1 millimeter.

8. The pump of claim 7 wherein the axial length of the non-engaging surface portion is at least about 2 millimeters.

9. A pump for a fuel injection system, the pump comprising:

a pump body having a pumping chamber, a fuel inlet for supplying fuel to the pumping chamber, an outlet port, and a valve chamber between the pumping chamber and the outlet port, the valve chamber defining a valve seat and having an axial guiding portion with a central axis;

a plunger disposed in the pumping chamber;

a valve body disposed in the valve chamber for controlling fuel, the valve body having a valve stem defining a seating surface, the valve body further having a valve guide in sliding engagement with the valve chamber guiding portion, and the valve body being axially movable with respect to the valve chamber over a stroke range between a closed position in which the seating surface engages the valve seat and an open position in which the seating surface is spaced from the valve seat to allow pressure relief, the valve guide having an outer engagement surface that slidingly engages the valve chamber guiding portion with a clearance fit of at least about 5 micrometers, the engagement surface having an axial length of at most about 7 millimeters;

a valve spring biasing the valve body toward the open position;

an armature at the valve body; and a stator near the armature and including an actuator operative to urge the valve body toward the closed position against the bias of the valve spring.

10. The pump of claim 9 wherein the valve seating surface has a radially inner portion and a radially outer portion, and the valve seating surface defines a step between the inner and outer portions.

11. The pump of claim 9 wherein the clearance fit is at most about 9 micrometers.

12. The pump of claim 11 wherein the clearance fit is at least about 6 micrometers.

13. The pump of claim 12 wherein the clearance fit is at most about 8 micrometers.

14. The pump of claim 9 wherein the axial length of the engagement surface is at least about 6 millimeters.

15. The pump of claim 14 wherein the axial length of the engagement surface is at most about 6.7 millimeters.

16. The pump of claim 15 wherein the axial length of the engagement surface is at least about 6.3 millimeters.

17. The pump of claim 14 wherein the valve guide has an axial length of at least about 9 millimeters.

18. The pump of claim 17 wherein the valve guide has a non-engaging surface portion between the outer engagement surface portion and the valve stem, the non-engaging surface portion having an axial length of at least about 1 millimeter.

19. The pump of claim 18 wherein the axial length of the non-engaging surface portion is at least about 2 millimeters.

20. A unit injector for a fuel injection system, the injector comprising:

an injector body having a pumping chamber and a valve chamber defining a valve seat and having an axial guiding portion with a central axis, and including a nozzle assembly;

a plunger disposed in the pumping chamber;

a valve body disposed in the valve chamber for controlling fuel, the valve body having a valve stem defining a seating surface, the valve body further having a valve guide in sliding engagement with the valve chamber guiding portion, and the valve body being axially movable with respect to the valve chamber over a stroke range between a closed position in which the seating surface engages the valve seat and an open position in which the seating surface is spaced from the valve seat to allow pressure relief, the valve guide having an outer engagement surface that slidingly engages the valve chamber guiding portion with a clearance fit of a first distance, the engagement surface having an axial length of a second distance, and wherein a ratio of the first distance to the second distance is at least about 5 to 7000;

a valve spring biasing the valve body toward the open position;

an armature at the valve body; and a stator near the armature and including an actuator operative to urge the valve body toward the closed position against the bias of the valve spring.

21. A unit injector for a fuel injection system, the injector comprising:

an injector body having a pumping chamber and a valve chamber defining a valve seat and having an axial guiding portion with a central axis, and including a nozzle assembly;

a plunger disposed in the pumping chamber;

a valve body disposed in the valve chamber for controlling fuel, the valve body having a valve stem defining a seating surface, the valve body further having a valve guide in sliding engagement with the valve chamber guiding portion, and the valve body being axially movable with respect to the valve chamber over a stroke range between a closed position in which the seating surface engages the valve seat and an open position in which the seating surface is spaced from the valve seat to allow pressure relief, the valve guide having an outer engagement surface that slidingly engages the valve chamber guiding portion with a clearance fit of at least about 5 micrometer, the engagement surface having an axial length of at most about 7 millimeters;

a valve spring biasing the valve body toward the open position;

an armature at the valve body; and a stator near the armature and including an actuator operative to urge the valve body toward the closed position against the bias of the valve spring.

* * * * *